US009818571B2

(12) United States Patent
Shiozawa et al.

(10) Patent No.: US 9,818,571 B2
(45) Date of Patent: Nov. 14, 2017

(54) X-RAY GENERATION TUBE, X-RAY GENERATION APPARATUS, AND RADIOGRAPHY SYSTEM

(71) Applicant: CANON KABUSHIKI KAISHA, Tokyo (JP)

(72) Inventors: Takashi Shiozawa, Tokyo (JP); Kazuya Tsujino, Tokyo (JP); Koichi Tsunoda, Yokohama (JP); Nobuhiro Ito, Yamato (JP); Kazuhiro Sando, Atsugi (JP); Yoichi Ikarashi, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 59 days.

(21) Appl. No.: 14/950,570

(22) Filed: Nov. 24, 2015

(65) Prior Publication Data

US 2016/0155598 A1 Jun. 2, 2016

(30) Foreign Application Priority Data

Nov. 28, 2014 (JP) ..... 2014-242457

(51) Int. Cl.
*H01J 35/08* (2006.01)
*H01J 35/16* (2006.01)
(Continued)

(52) U.S. Cl.
CPC ..... *H01J 35/08* (2013.01); *H01J 35/06* (2013.01); *H01J 35/14* (2013.01); *H01J 35/16* (2013.01);
(Continued)

(58) Field of Classification Search
CPC .. H01J 35/08; H01J 35/14; H01J 35/06; H01J 35/16; H01J 2235/087; H01J 2235/1204; H01J 2235/186; H01J 2235/06; H01J 35/30; H01J 2235/16; H01J 35/00; H01J 35/02; H01J 2235/163; H01J 19/42
See application file for complete search history.

(56) References Cited

U.S. PATENT DOCUMENTS 5,751,784 A * 5/1998 Enck ..... H01J 35/30 378/119
2014/0056406 A1 2/2014 Yamazaki
2014/0369470 A1 12/2014 Ukiyo

FOREIGN PATENT DOCUMENTS

JP S55-178962 U 12/1980
JP S51-090856 A 6/1982
(Continued)

*Primary Examiner* — Hoon Song
(74) *Attorney, Agent, or Firm* — Canon U.S.A., Inc. IP Division

(57) ABSTRACT

An X-ray generation tube includes: an anode including a target configured to generate X-rays under irradiation of electrons, and an anode member electrically connected to the target; a cathode including an electron emitting source configured to emit an electron beam in a direction towards the target, and a cathode member electrically connected to the electron emitting source; and an insulating tube extending between the anode member and the cathode member. The anode further includes an inner circumferential anode layer electrically connected to the anode member, the inner circumferential anode layer extending along an inner circumferential face of the insulating tube, and is remote from the cathode member.

14 Claims, 6 Drawing Sheets

(51) Int. Cl.
*H01J 35/06* (2006.01)
*H01J 35/14* (2006.01)
*H05G 1/10* (2006.01)

(52) U.S. Cl.
CPC ..... *H05G 1/10* (2013.01); *H01J 2235/087* (2013.01); *H01J 2235/088* (2013.01); *H01J 2235/168* (2013.01)

(56) References Cited

FOREIGN PATENT DOCUMENTS

| | | | |
|---|---|---|---|
| JP | S58-044662 | A | 3/1983 |
| JP | 2002298772 | A | 10/2002 |
| JP | 2012104272 | A | 5/2012 |
| JP | 2014-102926 | A | 6/2014 |

* cited by examiner

X-RAY GENERATION TUBE, X-RAY GENERATION APPARATUS, AND RADIOGRAPHY SYSTEM

BACKGROUND OF THE INVENTION

Field of the Invention

The present invention relates to an X-ray generation apparatus that is applicable to non-destructive X-ray imaging in the fields of medical equipment and industrial equipment and so forth, and a radiography system having the X-ray generation apparatus.

Description of the Related Art

As of recent, X-ray inspection apparatuses having micro-focus X-ray generation tubes have come to be used in inspection of electronic devices. The micro-focus X-ray generation tubes applied to such X-ray inspection apparatuses are known to be transmission X-ray generation tubes having transmission targets. Transmission X-ray generation tubes are advantageous in comparison with reflection targets, with regard to the point that a broad radiation angle, a short source-object distance (SOD), and a great enlargement factor, can be ensured.

Japanese Patent Laid-Open No. 2012-104272 discloses a transmission micro-focus X-ray generation tube where electroconductive bellows are disposed behind the target, thereby suppressing charging of the bellows due to backward scattered electrons and stabilizing the electron trajectory. Japanese Patent Laid-Open No. 2012-104272 further discloses that the transmission micro-focus X-ray generation tube described therein improves positional accuracy of the focal point and reduces out-of-focus states, due to suppressing charging.

Japanese Patent Laid-Open No. 2002-298772 discloses a transmission micro-focus X-ray generation tube where an electron emitting source having a focusing lens electrode at the tip thereof is in close proximity of the target.

Both Japanese Patent Laid-Open No. 2012-104272 and Japanese Patent Laid-Open No. 2002-298772 disclose a transmission micro-focus X-ray generation tube having an electron emitting source that protrudes toward the target, and a tubular anode member extending at the cathode side so as to overlap the electron emitting source in the axial direction of the tube.

SUMMARY OF THE INVENTION

The transmission micro-focus X-ray generation tubes disclosed in Japanese Patent Laid-Open No. 2012-104272 and Japanese Patent Laid-Open No. 2002-298772 have a relatively short insulation distance as to creeping distance in the anode/cathode tube axial direction of the X-ray generation tube in particular, so it is difficult to realize both reduction in size and necessary resolution (upper limit of X-ray tube voltage), and accordingly merchantability has been limited.

It has been found desirable to provide a transmission micro-focus X-ray generation tube and transmission micro-focus X-ray generation apparatus which realizes both voltage withstanding performance and reduction in size. It has also been found desirable to provide a radiography system capable of yielding high-definition transmission X-ray images.

An X-ray generation tube includes: an anode including a target configured to generate X-rays under irradiation of electrons, and an anode member electrically connected to the target; a cathode including an electron emitting source configured to emit an electron beam in a direction toward the target, and a cathode member electrically connected to the electron emitting source; and an insulating tube extending between the anode member and the cathode member. The anode further includes an inner circumferential anode layer electrically connected to the anode member, the inner circumferential anode layer extending along an inner circumferential face of the insulating tube, and is remote from the cathode member.

Further features of the present invention will become apparent from the following description of exemplary embodiments with reference to the attached drawings.

DESCRIPTION OF THE EMBODIMENTS

Figure 1A:
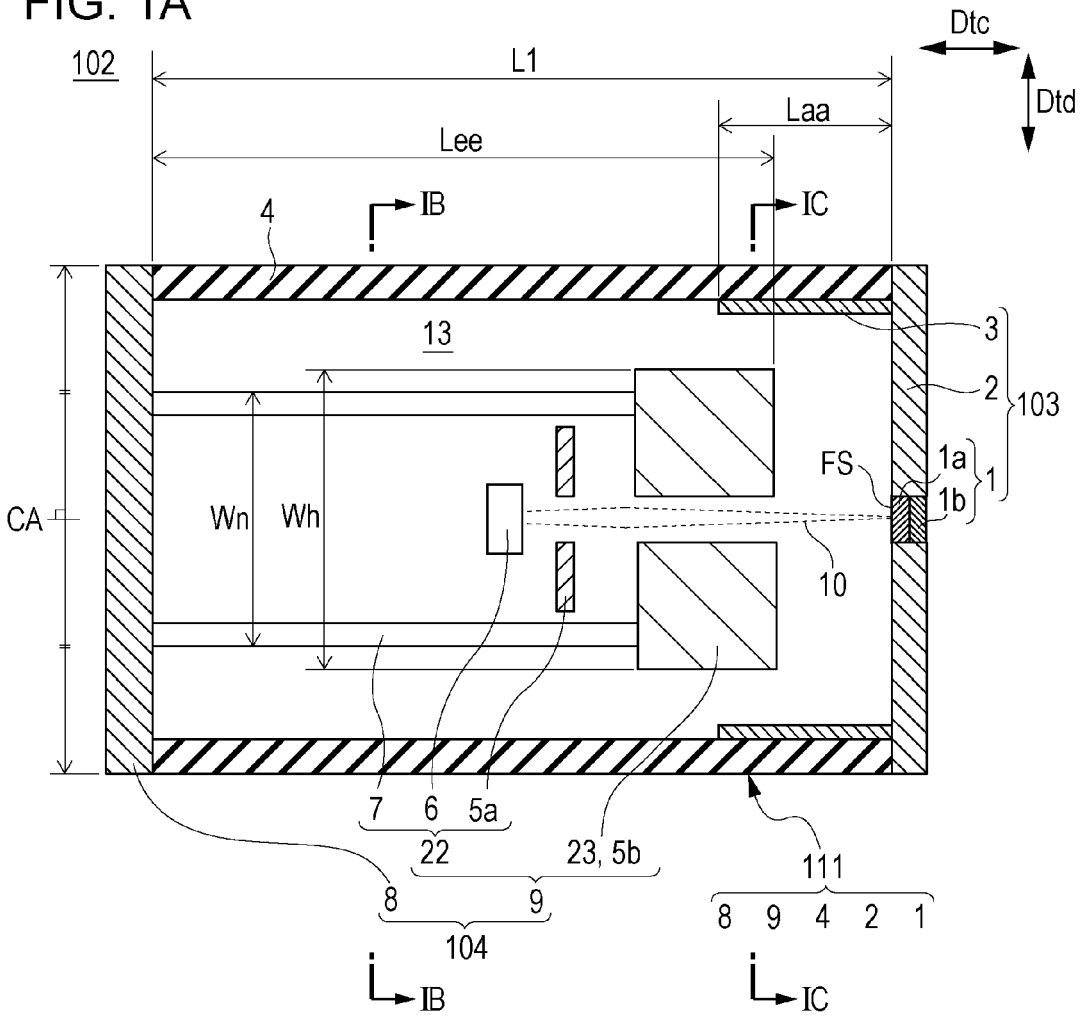
FIGS. 1A through 1C are schematic configuration diagrams illustrating an X-ray generation tube according to a first embodiment of the present invention.

Exemplary description will be made below regarding embodiments of an X-ray generation tube and a micro-focus X-ray generation apparatus according to the present invention with reference to the drawings. It should be noted, however, that materials, dimensions, shapes, positional relations, and so forth, of configurations described in the embodiments are not intended to restrict the scope of the present invention unless specifically stated. Description will be made regarding an X-ray generation tube 102, an X-ray generation apparatus 101, and a radiography system 200, with reference to FIGS. 1A through 5.

First Embodiment: X-ray Generation Tube

First, the basic configuration of the X-ray generation tube according to the present invention will be described with reference to FIGS. 1A through 1C, which illustrate the transmission X-ray generation tube 102 according to a first embodiment. The X-ray generation tube 102 has an electron emitting source 9 and a transmission target 1. The present invention pertains to a transmission X-ray generation tube having a transmission target. Accordingly, the terms "transmission target" and "transmission X-ray generation tube" will hereinafter be referred to simply as "target" and "X-ray generation tube" in the present specification, for sake of brevity.

The X-ray generation tube 102 generates X-rays by irradiating the target 1 by an electron beam flux 10 discharged from an electron discharge unit 6 which the electron emitting source 9 has. A cathode 104 includes at least the electron emitting source 9 that discharges electrons, and a cathode member 8 serving as an electrode member that defines an electrostatic field at the cathode side of the X-ray generation tube 102 and as a structural member making up an enclosure 111.

An insulating tube 4 serves to insulate between the cathode 104 and a later-described anode 103, and also makes up the enclosure 111 along with the anode 103 and cathode 104. An inner space 13 is defined by the enclosure 111. The insulating tube 4 is configured using an insulating material such as a glass material or a ceramic material or the like. The insulating tube 4 is connected to each of the cathode 104 and the later-described anode 103 at both ends in a tube axial direction Dtc, so that the later-described target 1 and the electron emitting source 9 face each other.

The anode 103 includes at least the target 1 that generates X-rays by being irradiated by electrons, and an anode member 2 serving as an electrode member that regulates the potential at the target 1 and the potential at the anode side of the X-ray generation tube 102 and as a structural member making up an enclosure 111. The anode 103 according to the present embodiment is further provided along the inner circumferential face of the later-described insulating tube 4 and extends from the anode member 2 toward the cathode member 8. The anode 103 includes an inner circumferential anode layer 3 that is remote from the cathode member 8.

Figure 1B:
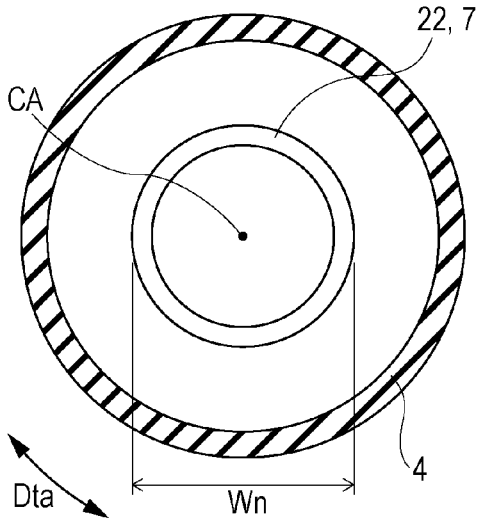
Figure 1C:
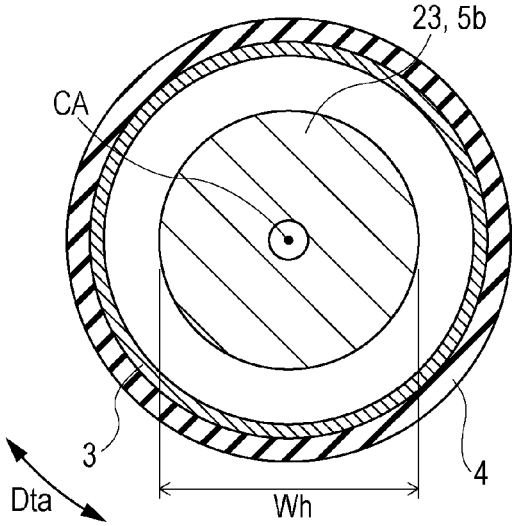

The inner circumferential anode layer 3 covers the inner circumferential face of the insulating tube 4 partway from the anode 103 side toward the cathode 104 in the tube axial direction Dtc, by a creeping distance Laa, as illustrated in FIGS. 1B and 1C. An anticathode anode end 11 which is the end portion of the inner circumferential anode layer 3 toward the cathode side annularly surrounds a head portion 23 of the electron emitting source 9 in the present embodiment. That is to say, the inner circumferential anode layer 3 surrounds the head portion 23 by extending the full circumference in the tube circumference direction Dta. The layout relationship between the head portion 23 and the anticathode anode end 11 will be described later.

Note that, FIGS. 1B and 1C show cross-sections taken along lines IB and IC in FIG. 1A, respectively. When defining directions regarding the X-ray generation tube 102 and the insulating tube 4 in the present description, one of the tube axial direction Dtc, tube circumference direction Dta, and tube radius direction Dtd will be used, as illustrated in FIGS. 1A through 1C. Each of the tube axial direction Dtc, tube circumference direction Dta, and tube radius direction Dtd matches the insulating tube 4 and X-ray generation tube 102 without loss of generality.

The tube axial direction Dtc corresponds to the direction in which the center of the opening of the insulating tube 4 extends in FIG. 1A. The tube axial direction Dtc is parallel to the normal lines of the cathode member 8 and anode member 2 in the present embodiment. The tube circumference direction Dta corresponds to the annular direction in which the tube wall of the insulating tube 4 extends in FIG. 1B. The tube radius direction Dtd is the direction regulating the diameter of the insulating tube 4, and agrees with a direction perpendicular to the tube axial direction Dtc while passing through a center axis CA of the insulating tube 4.

Figure 2A:
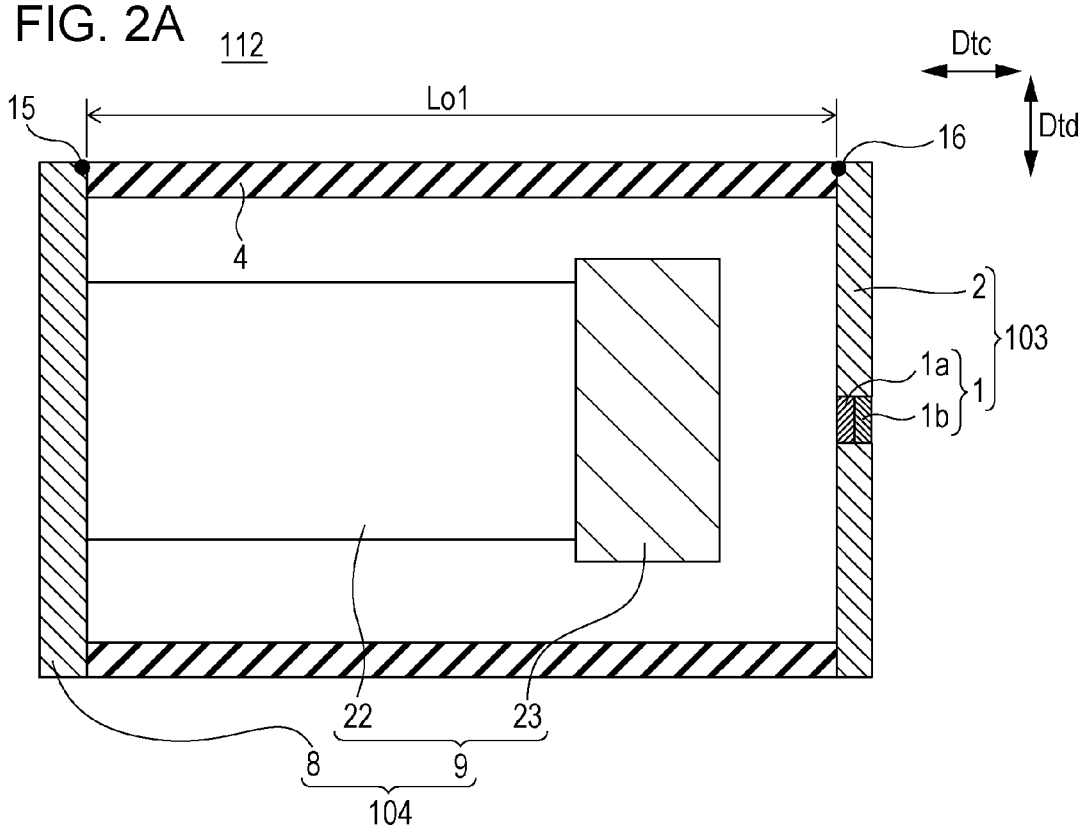
FIGS. 2A and 2B are schematic diagrams describing technological significance relating to the first embodiment.
Figure 2B:
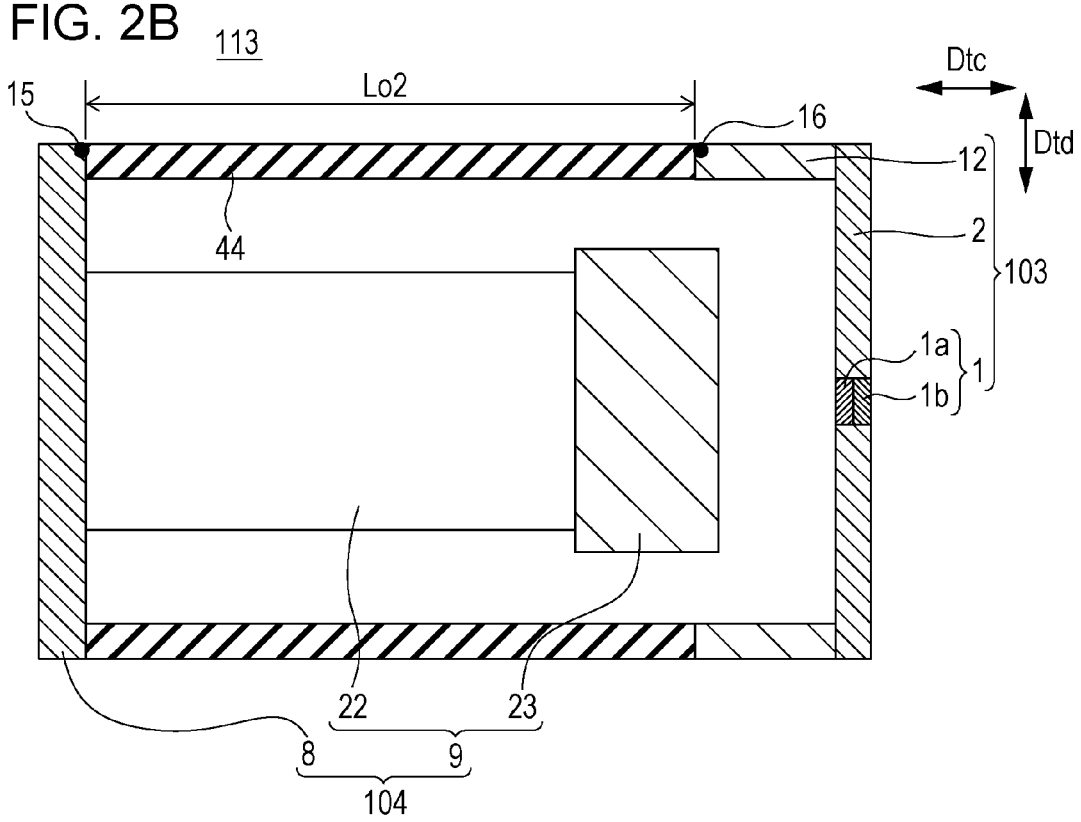

Next, the technological significance of the inner circumferential anode layer, which is a feature of the present invention, will be described with reference to FIGS. 1A through 3C. FIGS. 2A and 2B illustrate X-ray generation tubes 112 and 113 as reference examples that differ from the X-ray generation tube 102 according to the first embodiment with regard to the point that they do not have the inner circumferential anode layer.

The X-ray generation tube 112 according to the reference example illustrated in FIG. 2A exhibited "shift" of the X-ray focal point FS depending on the exposure history thereof. The present inventors have, through diligent study, found that the reason of this shift of focal point is that the inner circumferential face of the insulating tube 4 becomes charged by backscattering X-rays backscattered behind the focal point.

The mechanism that has been identified is as follows.

The inner circumference face of the insulating tube 4 is charged at the anode side, due to the backscattered X-rays from the focal point FS entering the inner circumference face of the insulating tube 4 at the anode side.

This charge has a non-uniform distribution in the tube axial direction Dtc and tube circumference direction Dta.

The electrostatic field between the electron emitting source 9 and the target 1 is deformed due to this charge, and accordingly the trajectory of the electron beam flux 10 is shifted.

The inner circumferential anode layer 3, which is a feature of the present invention, has a first technological significance of exhibiting effects of suppressing charging of the insulating tube 4 due to the aforementioned backscattered electrons. This is due to the inner circumferential anode layer 3 being electrically connected to the anode member 2 while being situated at the anode side of the inner circumferential face of the insulating tube 4.

On the other hand, the X-ray generation tube 113 illustrated in FIG. 2B differs from the X-ray generation tube 112 according to the first reference example in that it has a tubular anode tube member 12 where the anode side of the drum projects from the anode member 2 toward the cathode side, and the anode tube member 12 and anode side end of the insulating tube 4 are connected. The X-ray generation tube 113 according to the second reference example replaces the region charged by backscattered electrodes described above, with an electroconductive member in the form of the anode tube member 12 that is situated on the insulating tube 4 side of the anode member 2 and electrically connected thereto. The X-ray generation tube 113 thus acts to effectively suppress the trajectory of the electron beam flux 10 from shifting.

However, there were cases with the X-ray generation tube 113 according to the second reference example where, depending on exposure history, discharge occurred and exposure operations had to be stopped. Analyzing the X-ray generation tube 113 where discharge occurred revealed that creeping discharge had been occurring, with the outer circumferential face of an insulating tube 44 as the discharge path. Further study by the present inventors revealed that the cause of creeping discharge occurring at the outer circumferential face of the insulating tube 44 was deterioration of the insulation performance of the outer circumferential face due to exposure history.

The mechanism of the creeping discharge occurring at the outer circumferential face of the insulating tube 44 that was found in the second reference example is as follows.

An insulation distance Lo2 of the X-ray generation tube 113 according to the second reference example was shorter than an insulation distance Lo1 of the X-ray generation tube 112 according to the first reference example, and accordingly minute discharge occurs more readily than with the X-ray generation tube 112.

Contaminants and foreign substances that unavoidably exist on the outer portion of the X-ray generation tube 113 within an accommodation container 107 adhere to the outer circumferential face of the insulating tube 44 due to minute discharges from operation of the X-ray generation tube 113.

The contaminants accumulated on the outer circumferential face of the insulating tube 44 include a component with higher electroconductivity than the insulating tube 44.

The accumulated contaminants are non-uniformly distributed on the outer circumferential face of the insulating tube 44 in some cases.

Thus, the insulating tube 44 according to this reference example is subject to change where effectively necessary insulation distance deteriorates. On the other hand, the inner circumferential anode layer 3 which is a feature of the present invention is electrically connected to the anode member 2 and is situated on the inner circumferential face of the insulating tube 4 at the anode side, and accordingly suppresses charging of the insulating tube 4 due to backscattered electrons without deteriorating voltage withstanding performance of the outer circumferential face of the insulating tube 4. This is a second technological significance. Note that the contaminants and foreign substances that unavoidably exist on the X-ray generation tube 102 within the accommodation container 107 are either foreign substances introduced within the accommodation container 107 at the time of manufacturing, or contaminants generated after accommodation as thermal decomposition or discharge residue.

Figure 3A:
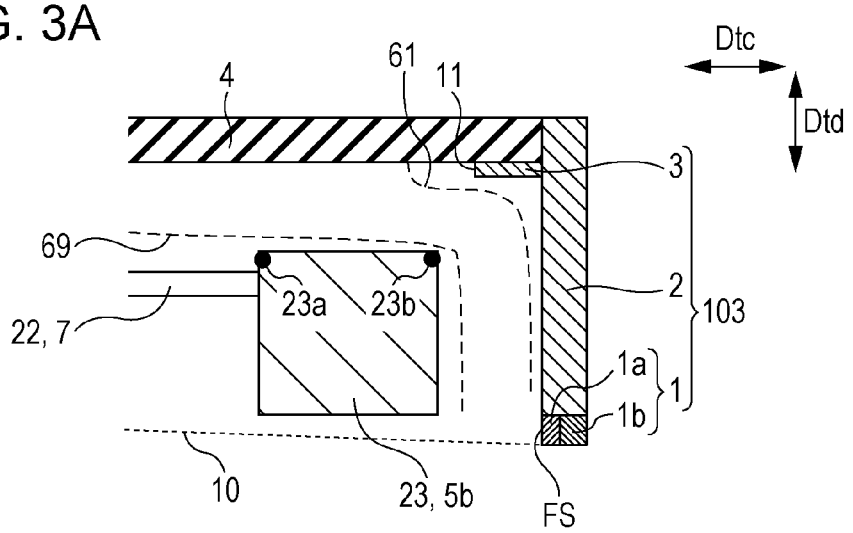
FIGS. 3A through 3C are schematic diagrams describing other technological significance relating to the first embodiment.
Figure 3B:
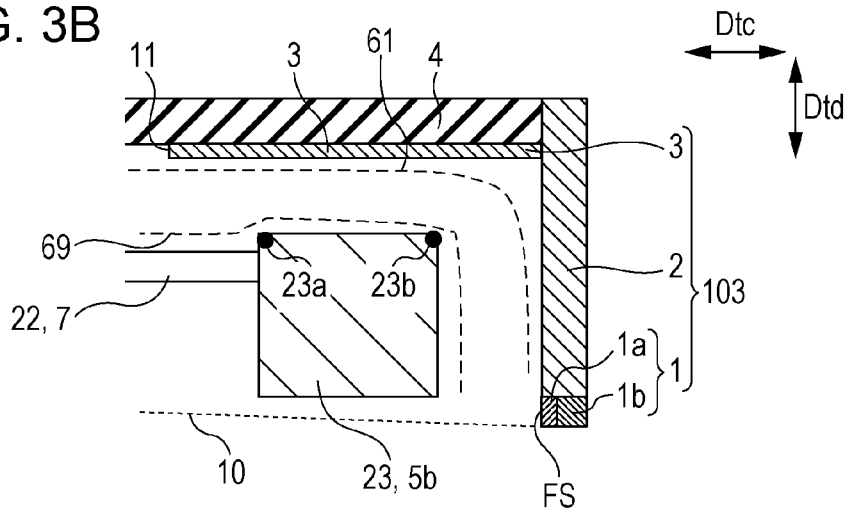
Figure 3C:
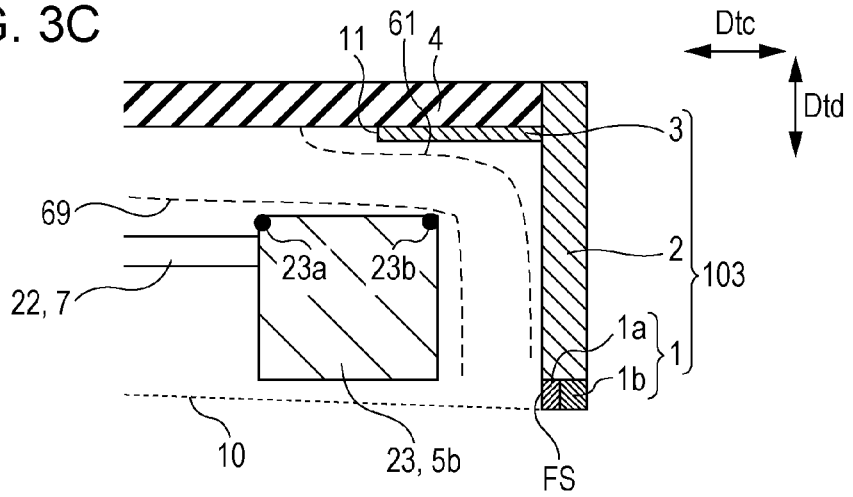

Next, the formation range of the inner circumferential anode layer 3 in the tube axial direction Dtc will be described with reference to FIGS. 3A through 3C. FIG. 3C is a partially enlarged view where a principal portion of the X-ray generation tube 102 according to the first embodiment of the present invention, including the inner circumferential anode layer 3, has been enlarged. That is to say, FIG. 3C can be considered to be a partial cross-section of the first embodiment illustrated in FIG. 1A, in the tube axial direction Dtc and tube radius direction Dtd. FIGS. 3A through 3C illustrates equipotential lines 61 and 69 that correspond to spatial potential of −0.1×Va (V) and −0.9×Va (V), regarding X-ray tube voltage Va, cathode potential (−Va), and anode potential 0 (V), by dashed lines.

FIGS. 3A and 3B each illustrate modifications where the formation range of the inner circumferential anode layer 3 of the X-ray generation tube 102 according to the first embodiment has been changed. The first embodiment and modifications illustrated in FIGS. 3A through 3C all exhibit effects of suppressing charging of the base 4 due to the aforementioned backscattered electrons, and suppressing creeping discharge at the outer circumferential face of the insulating tube 4, as a result of having the inner circumferential anode layer 3, which is a feature of the present invention.

The inner circumferential anode layer 3 of the first modification illustrated in FIG. 3A is not extended in the tube axial direction Dtc to where the inner circumferential anode layer 3 overlaps the electron emitting source 9. Accordingly, part of the backscattered electrodes scattering backwards from the focal point FS are cast into the inner circumferential face of the insulating tube 4 near the anticathode anode end 11 under influence of the electric field formed between the electron emitting source 9 and the anode 103, and charge the insulating tube 4, albeit slightly.

On the other hand, the first embodiment and a modification illustrated in FIGS. 3B and 3C have the inner circumferential anode layer 3 overlapping the electron emitting source 9 in the tube axial direction Dtc, so backscattered electrons from the focal point FS are suppressed from being cast into the insulating tube 4, and rather are cast into the inner circumferential anode layer 3. Electrons cast into the inner circumferential anode layer 3 are directed to a ground terminal via the anode member 2. Accordingly, the present embodiment and modification where the inner circumferential anode layer 3 overlaps the electron emitting source 9 in the tube axial direction Dtc exhibit the effect where shifting of the beam due to backscattered electrodes from the focal point FS is effectively suppressed.

The inner circumferential anode layer 3 of the modification of the first embodiment illustrated in FIG. 3B has the inner circumferential anode layer 3 extended in the tube axial direction Dtc to a position overlapping the electron emitting source 9, and further extended past the head portion 23 where a focusing lens electrode 5*b* is disposed, to a small-diameter neck portion 22.

Note that the expression of the inner circumferential anode layer 3 and electron emitting source 9 overlapping in the tube axial direction Dtc as used in the present specification means that, when the structure of the X-ray generation tube 102 is projected in the tube radius direction Dtd, the orthogonal projection images of the inner circumferential anode layer 3 and the electron emitting source 9 overlap. Accordingly, it can be said that the overlapping of the inner circumferential anode layer 3 and the electron emitting source 9 is such that an imaginary plane can exist perpendicular to the tube axial direction Dtc passing through the inner circumferential anode layer 3 and electron emitting source 9 (23, 22), as illustrated in FIG. 1B. This imaginary plane corresponds to the cross-section line IC-IC in FIG. 1A.

On the other hand, the first embodiment and modifications illustrated in FIGS. 3A through 3C have the tip of the anode side of the electron emitting source 9 in close proximity with the target 1, to suppress positional shift of the focal point FS, which is to say to stabilize the rectilinear advance property of the trajectory of the electron beam flux 10. The electron emitting source 9 of the first embodiment and modifications illustrated in FIGS. 3A through 3C also includes the focusing lens electrode 5*b*, to miniaturize the focal point at the focal point FS. The electron emitting source 9 includes the focusing lens electrode 5*b* at the electroconductive head portion 23 that has a larger width Wh than the neck portion 22 in the tube radius direction Dtd, from the perspective of uniformity of the electric field between the electron emitting source 9 and the anode 103. The head portion 23 is situated at the end of the electron emitting source 9 on the anode side thereof, and faces the anode member 2. The head portion 23 has a transition portion edge 23*a* at the transition portion from the neck portion 22, and an anode side edge 23*b* at the side toward the anode 103.

In the modification illustrated in FIG. 3B, the equipotential line 61 where −0.1×Va (V) extends past the head portion 23 to the cathode side, and terminates at the inner circumference of the insulating tube 4, as a result of the inner circumferential anode layer 3 having been extended to the neck portion 22. As a result, the equipotential line 69 where −0.9×Va (V) in proximity with the electron emitting source 9 bends away from the equipotential line 61 where −0.1×Va (V), at the transition portion edge 23*a*. That is to say, a slight electric field concentration occurs at the transition portion edge 23*a* in the present modification.

On the other hand, the first embodiment illustrated in FIG. 3C has the anticathode anode end 11 of the inner circumferential anode layer 3 overlapping the head portion 23 in the tube axial direction Dtc. Accordingly, the equipotential line 61 where −0.1×Va (V) terminates at the inner circumference of the insulating tube 4, around the position of the head portion 23 in the tube axial direction Dtc. As a result, the equipotential line 69 where −0.9×Va (V) extends toward the cathode side without bending at the transition portion edge 23*a*. That is to say, it can be seen from the present embodiment that an ideal electrostatic field is formed without concentration around the transition portion edge 23*a*.

As described above, an arrangement where the range of formation of the inner circumferential anode layer 3 overlaps the electron emitting source 9 in the tube axial direction Dtc, and particularly overlaps the head portion 23 in a case where there is a head portion 23, is preferable from the perspective of positional precision of the focal point FS and of suppressing discharge. Securing insulation distance for discharge voltage withstanding performance and reduction in size of the X-ray generation apparatus are in a trade-off relation, so the later-described X-ray generation apparatus having the X-ray generation tube according to the present invention, and the radiography system, have the advantage of reduction in size.

Next, the basic form of the X-ray generation tube 102 will be described in further detail, with reference to FIGS. 1A through 1C. The transmission plate 1*b* has an end window at the anode side of the X-ray generation tube 102. The target 1 has, in order from the side closer to the electron emitting source 9, a target layer 1*a*, and a transmission plate 1*b* that supports the target layer 1*a*. The target 1 is mechanically, electrically, thermally, and hermetically connected to the anode member 2 having an opening, by way of a brazing material such as a silver-tin (Ag—Sn) alloy or the like. The potential of the anode 103 that has at least the anode member 2 and the target 1 is regulated by a X-ray tube voltage circuit that is omitted from illustration, and serves to regulate the electrostatic field near the anode of the X-ray generation tube 102.

The enclosure 111 is preferably configured using a member having airtightness to maintain a vacuum, and sturdiness to withstand atmospheric pressure. The enclosure 111 is configured including the insulating tube 4, cathode member 8, electron emitting source 9, target 1, and anode member 2.

Electrons emitted from the electron emitting source 9 are accelerated to an incident energy necessary to generate X-rays at the target layer 1*a*, by an acceleration electric field formed between the cathode 104 to which the X-ray tube voltage Va has been applied and the anode 103, thus forming the electron beam flux 10.

The inner space 13 of the X-ray generation tube 102 is a vacuum, to secure a mean free path for the electrons discharged from the electron emitting source 9. The vacuum within the X-ray generation tube 102 preferably is in a range of 1E-8 Pa to 1E-4 Pa, and more preferably in a range of 1E-8 Pa to 1E-6 Pa from the perspective of lifespan of the electron emitting source 9. Accordingly, the electron discharge unit 6 and the target layer 1*a* are each disposed in the inner space 13 of the X-ray generation tube 102 or on the inner surface thereof.

The inner space 13 of the X-ray generation tube 102 can be evacuated to a vacuum by evacuating using an exhaust tube and vacuum pump, which are omitted from illustration, and then the exhaust tube being sealed off. Getters, also omitted from illustration, may be arrayed within the inner space 13 of the X-ray generation tube 102, to maintain the vacuum.

The target layer 1*a* is disposed on the side of the transmission plate 1*b* facing the electron discharge unit 6. The material of which the target layer 1*a* is configured preferably has a high melting point and high X-ray generation efficiency. Examples include tungsten, tantalum, molybdenum, alloys thereof, and so forth.

The material making up the transmission plate 1*b* preferably is one having sufficient strength to support the target layer 1*a*, having little absorption of X-rays generated at the target layer 1*a*, and having a high level of thermal conductivity so as to be able to quickly dissipate heat generated at the target layer 1*a*. Examples of materials that can be used include diamond, silicon carbide, aluminum nitride, and so forth. Note that the transmission plate 1*b* serves as a transmission window to extract X-rays generated at the target layer 1*a* to the outside of the X-ray generation tube 102, and also makes up part of the enclosure 111.

The electron emitting source 9 may include, as the electron discharge unit 6, a hot cathode such as a tungsten filament or an impregnated cathode, or a cold cathode such as carbon nanotubes or the like. The electron emitting source 9 may include a grid electrode 5*a* and an electrostatic lens electrode 5*b* to control the beam diameter and electron current density of the electron beam flux 10, on/off timing thereof, and so forth. The electrostatic lens electrode 5*b* is configured using a Pierce focusing lens electrode in the present embodiment.

The anode member 2 and cathode member 8 are made using a metal such as stainless steel or alloys with a low coefficient of linear expansion, such as Monel (U.S. Registered Trademark serial No. 71136034, a nickel-copper alloy), Inconel (U.S. Registered Trademark serial No. 71333517, a nickel-based superalloy), Kovar (U.S. Registered Trademark serial No. 71367381, a nickel-cobalt ferrous alloy), or the like.

The inner circumferential anode layer 3 is preferably formed using a material that is non-magnetic and has high electroconductivity. Examples include metals such as copper, tungsten, titanium, and so forth, alloys having these metals as the principal component, compound materials using these, and glazes or the like. The inner circumferential anode layer 3 is continuously formed in the circumferential direction on the inner circumferential face of the insulating tube 4. The inner circumferential anode layer 3 is preferably in the range of 10 nm to 1 mm in thickness, and more preferably in the range of 100 nm to 50 μm. The lower limit of the thickness of the inner circumferential anode layer 3 is determined by the depth of electron penetration of backscattered electrons to the inner circumferential anode layer 3, and can be decided by the density, specific gravity, and X-ray tube voltage Va of the inner circumferential anode layer 3. The upper limit of the thickness of the inner circumferential anode layer 3 is decided from the perspective of mismatching in linear thermal expansion coefficient with the insulating tube 4, and can be decided according to the linear thermal expansion coefficient the materials of each of the insulating tube 4 and the inner circumferential anode layer 3.

Second Embodiment: X-Ray Generation Apparatus

Figure 4:
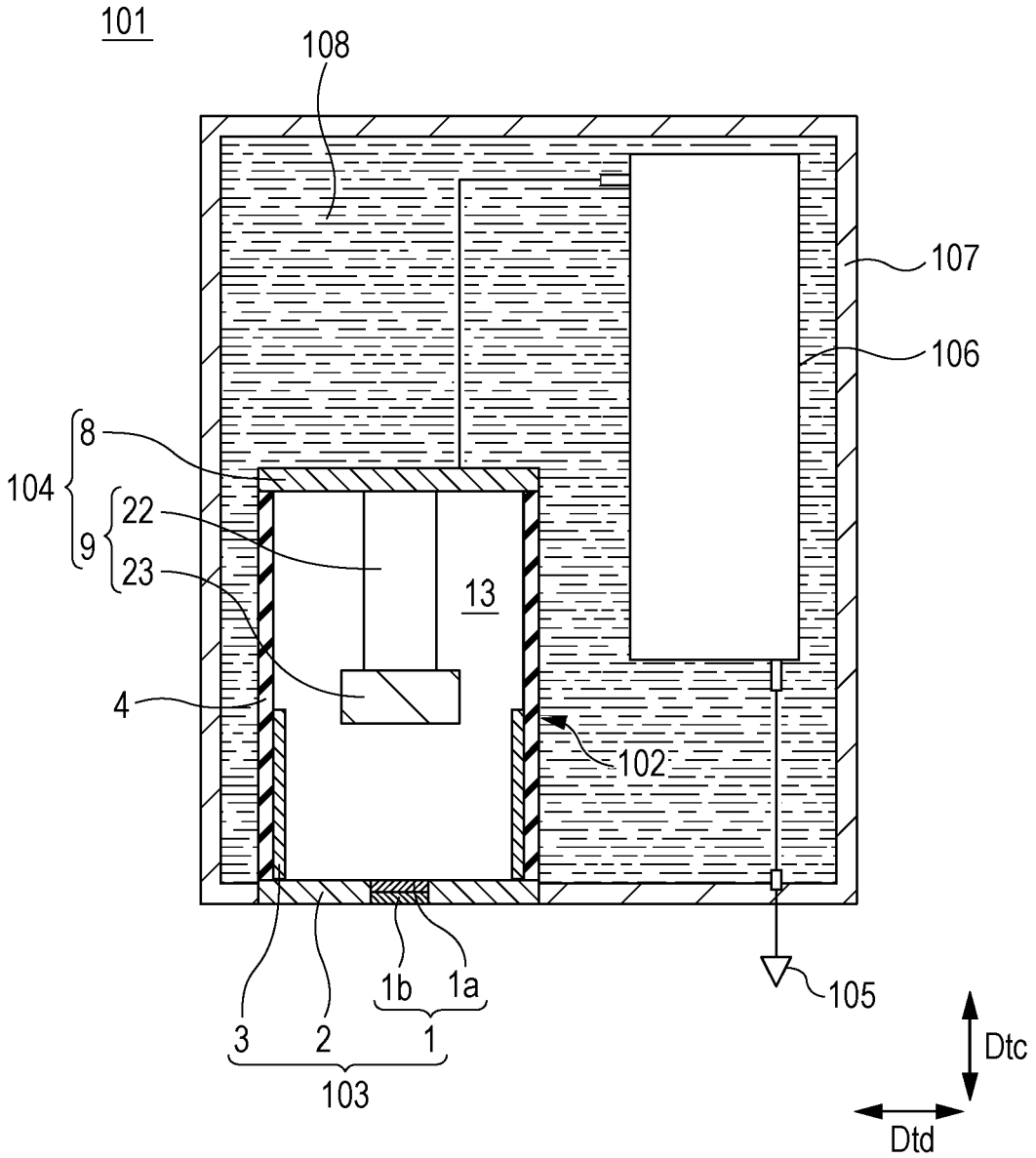
FIG. 4 is a configuration diagram illustrating an X-ray generation apparatus according to a second embodiment of the present invention.

FIG. 4 is a schematic diagram illustrating the X-ray generation apparatus 101 according to a second embodiment of the present invention. The X-ray generation apparatus 101 includes a tube driving circuit 106 to drive the X-ray generation tube 102 according to the first embodiment. The tube driving circuit 106 includes at least a tube voltage circuit that applies X-ray tube voltage Va across the anode 103 and cathode 104 of the X-ray generation tube 102. The tube driving circuit 106 may include a grid control circuit that controls a multi-electrode tube electron gun (electron emitting source 9) having a grid electrode such as a triode, tetrode, or the like, electrostatic lens electrode, or the like.

The tube driving circuit 106 in the embodiments illustrated in FIGS. 1A through 1C and 4 includes a grid control circuit omitted from illustration, that controls the grid electrode 5*a* and electrostatic lens electrode 5*b* that make the current density of discharged electrons to be variable. The tube driving circuit 106 according to the present embodiment is accommodated within an electroconductive accommodation container 107, along with an insulating fluid 108 and the X-ray generation tube 102.

The tube driving circuit 106 and X-ray generation tube 102 according to the present embodiment are anode-grounded via the accommodation container 107. Accordingly, the cathode 104 is regulated to a negative potential −Va (V) as to the accommodation container 107. A modification where the tube driving circuit 106 is situated outside of the accommodation container 107, and externally supplies the X-ray generation tube 102 with electric power via a current input terminal that is omitted from illustration, is also included in the present invention. The accommodation container 107 preferably has electroconductivity to regulate the potential, from the perspective of usability and safety, and is configured using metal members of aluminum, brass, stainless steel, and so forth.

The insulating fluid 108 guarantees insulation of the X-ray generation tube 102, tube driving circuit 106, and other components within the accommodation container 107 from each other, and also guarantees insulation performance of the components based on potential difference. The insulating fluid 108 can also be said to be a cooling medium that performs convection heat exchange between the tube driving circuit 106 and X-ray generation tube 102 (high-temperature portions) and accommodation container 107 (low temperature portion) based on temperature difference within the X-ray generation apparatus 101. Mineral oil, synthetic oil, sulfur hexafluoride (SF6), and so forth are suitable for the insulating fluid 108. Brass, stainless steel, aluminum, and so forth are suitable for the accommodation container 107. A Cockcroft-Waiton circuit is applicable as: the tube driving circuit 106.

The X-ray generation apparatus 101 according to the present embodiment includes the X-ray generation tube 102 according to the first embodiment. Accordingly, the X-ray generation apparatus 101 guarantees the rectilinear advance property of the electron beam trajectory by suppressing charging of the insulating tube 4 from backscattered electrons from the target 1, without sacrificing voltage withstanding performance of the outer face of the insulating tube 4. The X-ray generation apparatus 101 according to the present embodiment thus can be driven at high X-ray tube voltage without necessity increase in size of the X-ray generation tube 102 and X-ray generation apparatus 101, and has X-ray discharge characteristics where focal point position accuracy is high and out-of-focus state is suppressed. The X-ray generation apparatus 101 according to the present embodiment also exhibits effects of suppressed X-ray output variation coming from minute discharge, due to the inner circumferential anode layer 3 and electron emitting source 9 having been positioned so as to overlap in the tube axial direction Dtc.

Third Embodiment: Radiography System

Figure 5:
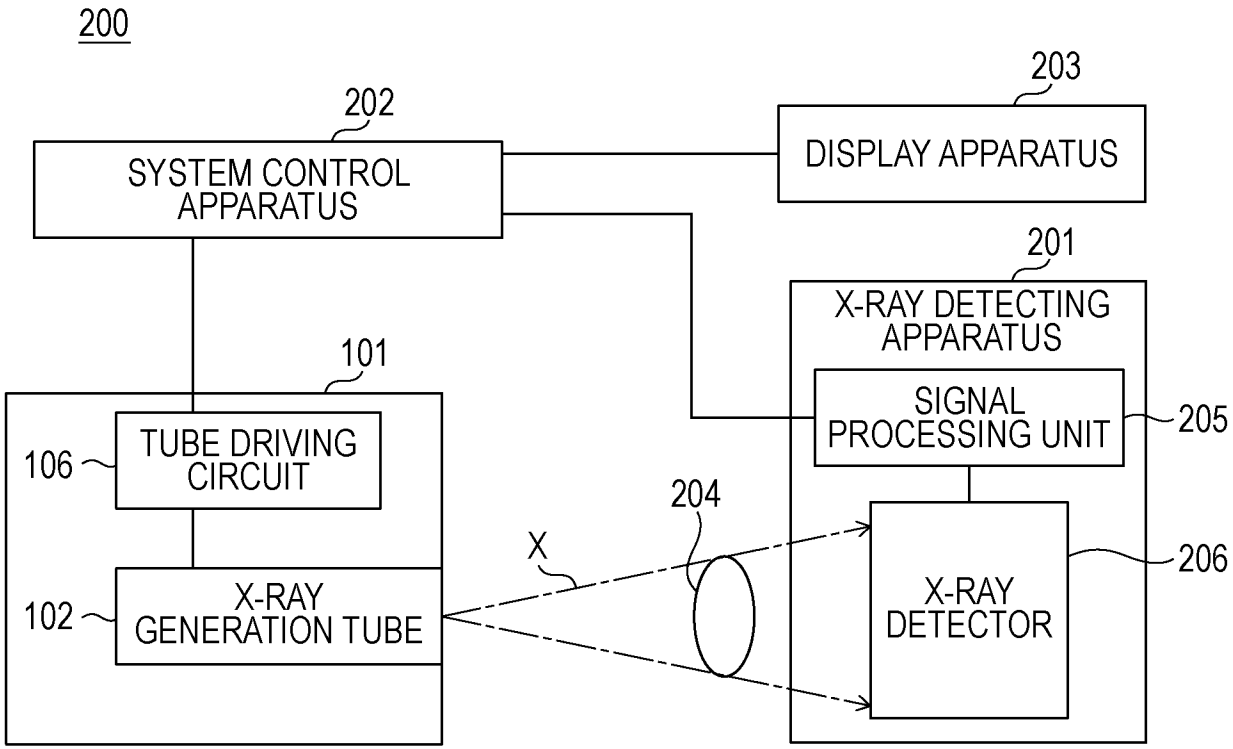
FIG. 5 is a configuration diagram illustrating a radiography system according to a third embodiment of the present invention.

FIG. 5 is a configuration diagram illustrating a radiography system 200 according to a third embodiment of the present invention. A system control apparatus 202 centrally controls the X-ray generation apparatus 101 according to the second embodiment and an X-ray detecting apparatus 201.

The tube driving circuit 106 outputs various types of control signals to the X-ray generation tube 102, under control by the system control apparatus 202. The discharge state of X-rays discharged from the X-ray generation apparatus 101 is controlled by the control signals output from the system control apparatus 202. The X-rays X emitted from the X-ray generation apparatus 101 pass through a subject 204 and are detected at an X-ray detector 206. The X-ray detector 206 has multiple detectors that are omitted from illustration. The X-ray detector 206 acquires a transmission X-ray image, converts the acquired transmission X-ray image into image signals, and outputs to a signal processing unit 205. The signal processing unit 205 subjects the image signals to predetermined signal processing under control by the system control apparatus 202, and outputs the processed image signals to the system control apparatus 202. The system control apparatus 202 outputs to a display apparatus 203 display signals to display an image on the display apparatus 203 based on the processed image signals. The display apparatus 203 displays the image based on the display signals on a screen thereof, as a photographed image of the subject 204. A slit, collimator, etc., not illustrated in the drawings, may be disposed between the X-ray generation tube 102 and subject 204 to suppress unnecessary X-ray irradiation.

According to the present embodiment, the radiography system 200 has the transmission X-ray generation apparatus 101 that is small in size and has excellent discharge voltage withstanding performance. The radiography system 200 thus is a highly-reliable system, capable of acquiring photographed images in a stable manner.

Exemplary Embodiment

Figure 6:
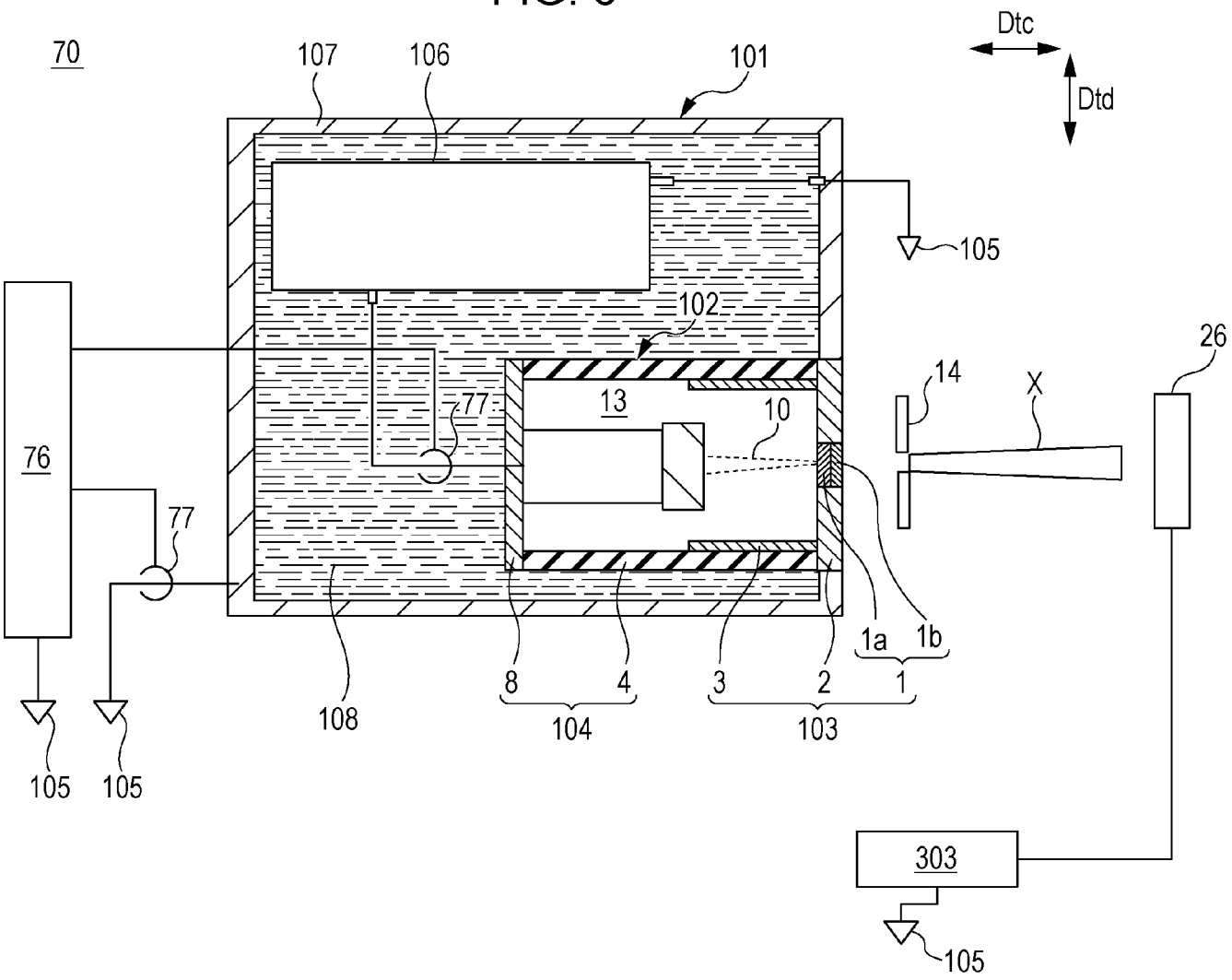
FIG. 6 is a configuration diagram illustrating an evaluation system for an exemplary embodiment.

The present exemplary embodiment is an example of the configuration illustrated in the above embodiments, and will be described in detail with reference to FIG. 1A and FIG. 6. FIG. 1A is a cross-sectional view of the X-ray generation tube 102 according to the present exemplary embodiment, and FIG. 6 is a configuration diagram illustrating an evaluation system 70 for evaluation of operating characteristics of the X-ray generation tube 102.

The X-ray generation tube 102 according to the present exemplary embodiment was fabricated as follows. First, a transmission plate 1*b* of a polycrystalline diamond was formed by chemical vapor deposition (CVD), using equipment manufactured by Sumitomo Electric Industries, Ltd. The transmission plate 1*b* was a disc (cylinder) 5 mm in diameter and 1 mm thick. Residual organic compound material on the transmission plate 1*b* was removed by cleansing using an ultraviolet (UV) ozone asher apparatus omitted from illustration.

On one of the two faces of the circular transmission plate 1*b* 5 mm in diameter, a target layer 1*a* of tungsten was deposited to a thickness of 7 μm by radio-frequency (RF) sputtering using argon (Ar) as a carrier gas. The transmission plate 1*b* was heated to 260° C. at the time of deposition.

Next, the anode member 2 was formed by forming a cylinder opening 1.1 mm in diameter at the center of a metal disc of Kovar, 60 mm in diameter and 3 mm thick. Organic compound material on the surface of the anode member 2 was removed by organic solvent cleaning, rinsing using a rinse liquid, and processing by an UV ozone asher apparatus.

Next, a silver brazing material was applied between the opening of the anode member 2 and the perimeter of the disc-shaped target 1, as a bonding material, and brazing was performed, thus obtaining the anode member 2 to which the target 1 was bonded.

Next, a disc-shaped Kovar cathode member 8, 60 mm in diameter and 3 mm thick, was prepared. A current input terminal, omitted from illustration, was connected to the center portion of the cathode member 8 by spot-welding. This cathode member 8 was also cleansed in the same way as the anode member 2.

The current input terminal was then connected to an impregnated electron gun, also omitted from illustration, thus yielding the cathode 104 having the electron emitting source 9.

Next, an insulating tube 4 formed of alumina, shaped as a circular pipe 70 mm long, having an outer diameter of 60 mm and a bore diameter of 50 mm, was prepared. The insulating tube 4 was cleansed in the same way as the cathode member 8 and anode member 2 thereby removing residual organic compound matter from the surface. Next, glancing angle deposition by RF sputtering was performed using a conical metal mask having equidistant apertures on the side face from the apex angle. Thus, a tungsten inner circumferential anode layer 3, 3 μm thick, was formed on the inner circumferential face of the insulating tube 4, from one end to a position 30 mm therefrom.

The cathode 104 and one end of the insulating tube 4 were then brazed using an Ag—Sn brazing material therebetween. Further, the other opening end of the insulating tube 4 and the anode member 2 were brazed in the same way as the cathode 104 and the insulating tube 4, so as to be sealed airtight. Thus, an airtight container made up of the cathode 104, anode 103, and insulating tube 4 was fabricated. The other opening end of the insulating tube 4 is the end at the side where the inner circumferential anode layer 3 was formed.

The inside of the airtight container was then evacuated to a vacuum of 1E-6 Pa using an exhaust tube and vacuum apparatus, which are omitted from illustration. Thereafter, the exhaust tube was sealed off, thereby fabricating the X-ray generation tube 102.

The fabricated X-ray generation tube 102 was accommodated in the accommodation container 107, along with the tube driving circuit 106 and insulating fluid 108, as illustrated in FIG. 6. The X-ray generation tube 102 was electrically connected to the tube driving circuit 106 that outputs the X-ray tube voltage Va and the brass accommodation container 107, so as to be anode-grounded. The cathode 104 was regulated to potential of −Va (V) as to the accommodation container 107 regulated to ground potential in the present exemplary embodiment. Thus, the X-ray generation apparatus 101 was fabricated.

Next, an X-ray intensity detector 26 was disposed on a normal line passing through the center of the target 1 of the X-ray generation apparatus 101, at a position 100 cm from the target 1. A probe 77 connected to a discharge counter 76 was coupled to connection wiring from the cathode 104 to the tube driving circuit 106 and to connection wiring from the accommodation container 107 to a ground terminal 105. Thus, the evaluation system 70 to evaluate the stability of the X-ray generation apparatus 101 was fabricated.

Evaluation of the stability of X-ray output was performed by performing X-ray irradiation for five seconds every time the electron emitting source 9 repeated a one-second irradiation period of one second and a pausing period of three seconds 100 times, at X-ray tube voltage Va of 60 kV. The X-ray output of the three seconds excluding the one second each at the start and end was observed. The electron emitting source 9 of the X-ray generation tube 102 was controlled to a fluctuation value within 1% by a negative feedback circuit, omitted from illustration, with regard to the X-ray tube current on the path between the cathode member 8 and the ground terminal 105.

Evaluation of electrostatic voltage withstanding testing was performed in a state with electron discharge of the electron emitting source 9 stopped, while gradually raising the X-ray tube voltage Va. Discharge voltage withstanding characteristics testing was performed using the discharge counter 76. The average fluctuation value of X-ray output by the X-ray generation apparatus 101 was 1.5%, and the evaluation value of discharge voltage withstanding of the X-ray generation tube 102 was 112 kV, both of which were excellent results.

According to the present invention, charging of the insulating tube can be prevented without sacrificing voltage withstanding performance of the outer face of the X-ray generation tube. Consequently, a high-definition X-ray generation apparatus can be provided with the electron beam trajectory stabilized, and out-of-focus states and fluctuation in focal position suppressed. Note that in the present specification, the terms "transmission micro-focus X-ray generation tube" and "transmission micro-focus X-ray generation apparatus" may be abbreviated to "X-ray generation tube" and "X-ray generation apparatus" respectively, for sake of brevity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-242457, filed Nov. 28, 2014, which is hereby incorporated by reference herein in its entirety.

What is claimed is:

1. An X-ray generation tube comprising:

an anode including a target configured to generate X-rays under irradiation of electrons, and an anode member electrically connected to the target;

a cathode including an electron emitting source configured to emit an electron beam in a direction towards the target, and a cathode member electrically connected to the electron emitting source; and an insulating tube extending between the anode member and the cathode member, wherein the anode further includes an inner circumferential anode layer electrically connected to the anode member, the inner circumferential anode layer extending along an inner circumferential face of the insulating tube, and is remote from the cathode member, and wherein the electron emitting source protrudes from the cathode member toward the target, and the inner circumferential anode layer has a portion overlapping the electron emitting source in a tube axial direction.

2. The X-ray generation tube according to claim 1, wherein the electron emitting source includes a head portion facing the anode member, and a neck portion connected to the head portion and the anode member, wherein the neck portion has a radius in a tube radius direction which is smaller than a radius of the head portion in a tube radius direction.

3. The X-ray generation tube according to claim 2, wherein the head portion is formed as an electrostatic lens electrode.

4. The X-ray generation tube according to claim 3, wherein the electrostatic lens electrode is a focusing lens electrode.

5. The X-ray generation tube according to claim 1, wherein the inner circumferential anode layer is continuous in a circumferential direction of the inner circumferential face of the insulating tube.

6. The X-ray generation tube according to claim 5, wherein the inner circumferential anode layer includes an anticathode anode end surroundings the head portion.

7. The X-ray generation tube according to claim 1, wherein the inner circumferential anode layer is formed to a thickness in a range of 10 nm to 1 mm.

8. The X-ray generation tube according to claim 7, wherein the inner circumferential anode layer is formed to a thickness in a range of 100 nm to 50 μm.

9. The X-ray generation tube according to claim 1, wherein the insulating tube is connected to the anode member and the cathode member such that the target and the electron emitting source face each other.

10. The X-ray generation tube according to claim 1, wherein the insulating tube extends between the anode member and the cathode member such that the anode member is connected at one end of the insulating tube in the tube axial direction, and the cathode member is connected at the opposite end of the insulating tube in the tube axial direction, and wherein an inner space is defined by the anode, the cathode, and the insulating tube.

11. An X-ray generation apparatus comprising:

the X-ray generation tube according to claim 1; and a tube voltage circuit configured to apply X-ray tube voltage across the anode and the cathode.

12. A radiography system comprising:

the X-ray generation apparatus according to claim 11;

an X-ray detector configured to detect X-rays generated by the X-ray generation apparatus and passed through a subject; and a system control apparatus configured to centrally control the X-ray generation apparatus and the X-ray detector.

13. The X-ray generation tube according to claim 1, wherein the electron emitting source protrudes from the cathode member toward the target, and the inner circumferential anode layer has a portion overlapping the electron emitting source in viewed from a radius direction of the insulating tube.

14. The X-ray generation tube according to claim 1, wherein the insulating tube includes an outer insulating distance and an inner insulating distance between the anode and the cathode, and wherein the outer insulating distance is longer than the inner insulating distance.

* * * * *